US006149203A

United States Patent [19]

Hanlon

[11] Patent Number: 6,149,203

[45] Date of Patent: Nov. 21, 2000

[54] TAMPER-EVIDENT CLOSURE SEAL

[75] Inventor: Robert G. Hanlon, Pleasanton, Calif.

[73] Assignee: Lifescan, Inc., Milpitas, Calif.

[21] Appl. No.: 08/507,623

[22] Filed: Jul. 26, 1995

[51] Int. Cl.[7] ..... B42D 15/00

[52] U.S. Cl. ..... 283/72; 428/41.7; 283/101

[58] Field of Search ..... 283/72, 103, 109, 283/98, 99; 40/299, 306, 312, 626, 630, 638, 661; 428/41.2, 915, 916

[56] References Cited

U.S. PATENT DOCUMENTS

| | | | |
|---|---|---|---|
| 1,590,158 | 6/1926 | Fletcher | 283/103 X |
| 3,524,782 | 8/1970 | Buske | 283/103 X |
| 3,854,581 | 12/1974 | Jones, Jr. | 283/103 X |
| 4,557,505 | 12/1985 | Schaefer et al. | 283/81 |
| 5,020,831 | 6/1991 | Benardelli | 283/108 |
| 5,265,794 | 11/1993 | Johnston | 229/102 |
| 5,399,405 | 3/1995 | Rennels, Jr. et al. | 283/103 X |

*Primary Examiner*—Willmon Fridie, Jr.
*Attorney, Agent, or Firm*—James Riesenfeld

[57] ABSTRACT

A tamper-evident closure seal is imprinted on its top surface to form a pattern of adjoining matte and high-gloss areas. The bottom surface of the seal is coated with a permanent adhesive. The seal may be used to bridge a gap between two perpendicular surfaces of a carton. If unauthorized entry to the carton is gained by cutting the seal along the gap, that entry can be detected even if the carton is resealed by overlapping the closure seal in register with a transparent seal of the same size and shape. The unauthorized entry will be evident, because the pattern on the original closure seal will not be visible through the overlaid transparent seal.

10 Claims, 2 Drawing Sheets

TAMPER-EVIDENT CLOSURE SEAL

BACKGROUND OF THE INVENTION

1. Field of Invention

This invention relates to a tamper-evident closure seal; more particularly, to a closure seal for cartons that prevents undetectable entry to the carton's contents.

2. Description of the Related Art

Manufacturers and distributors of consumer products have been sensitive for many years to the potential danger posed by persons gaining unauthorized access to their packaged products, particularly if that access is not evident to a subsequent buyer of the product. Manufacturers of consumer products, as well as packaging manufacturers, have developed a great variety of "tamper-evident" or "tamper-resistant" packaging.

Schaefer et al., U.S. Pat. No. 4,557,505, issued Dec. 10, 1985, discloses a tamper indicating package-closure tape that has a visible message which is changed when the tape is stressed. The tape provides one message when the package is sealed and a different message when it has been opened, because opening the package causes a transparent material to become opaque.

Bernardelli, U.S. Pat. No. 5,020,831, issued Jun. 4, 1991, discloses an interlaced multilayer that has a latent configuration that is rendered visible and irreversible by being transposed to a new support, for example by a label being stripped from a surface.

Johnston, U.S. Pat. No. 5,265,794, issued Nov. 30, 1993, discloses a tamper-evident folding carton that includes flaps sealed to one another. Opening a flap causes a tamper-indicating message to appear in a window at the carton end.

None of the references discussed above address a problem that arises when a product is sold in a carton that has one or more flaps ("tuck" and "dust" flaps) that simply fold into the carton. Those flaps are readily sealed by a closure seal that bridges the seam between an end and a side of the carton. However, if that seal is cut along the seam and subsequently resealed by a seal that is transparent and congruent with the original, the access to the contents of the carton can be concealed.

SUMMARY OF THE INVENTION

In accordance with the present invention, a tamper-evident closure seal has a top surface and a bottom surface, the bottom surface has an adhesive coating and the top surface has on it a pattern formed by adjoining high-gloss and matte areas. The contrasting reflectance of the adjoining areas makes the pattern visible in reflected light, particularly when viewed at an oblique angle.

A tamper-evident carton of the present invention has an edge seam that constitutes a gap between two carton surfaces at right angles to each other, the gap being bridged by a closure seal having a top surface and a bottom surface, the bottom surface having an adhesive coating and the top surface having on it a pattern formed by adjoining high-gloss and matte areas.

The closure seal of the present invention provides a way to close a gap between an end and a side of a carton. If the closure seal is cut along the gap and subsequently resealed—even if resealed with a transparent seal in register with the original seal—it will be evident that the original closure seal has been overlaid, because the original pattern of contrasting reflectances will no longer be visible. The simplicity of the closure seal of this invention, compared with alternatives disclosed by others, permits the seal to be manufactured and used at a lower cost.

DETAILED DESCRIPTION OF THE INVENTION

There is a need to package certain consumer products in packaging that is tamper-resistant or tamper-evident. The specific nature of the packaging depends, of course, on the nature and purpose of the product, the quantity to be packaged, etc. The need for tamper-evident packaging is particularly great for products that are ingested, such as foods and medicines. However, it may also be important to prevent tampering with products that are not ingested; for example, medical devices, such as test strips that are used by diabetics to measure their blood glucose.

Figure 1:
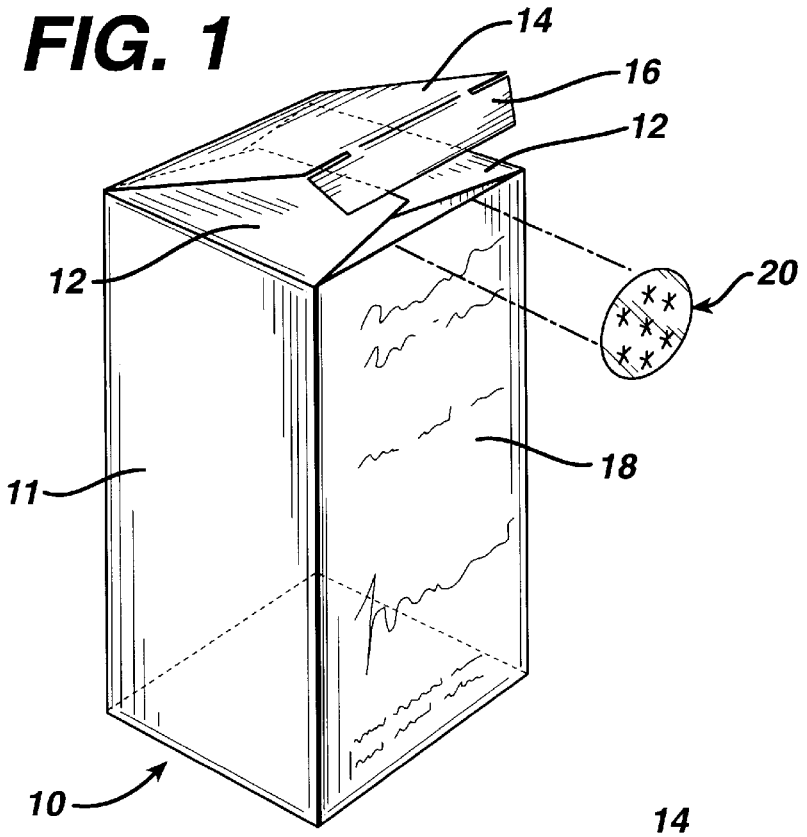
FIG. 1 is a perspective view of an unsealed carton and a closure seal of the present invention.

FIG. 1 is a perspective view of an open carton 10, which can be sealed by the closure seal 20 of the present invention. Seal 20 has imprinted on it a pattern—stars in this case—formed with a high-gloss or matte varnish (either solvent- or water-based) on a contrasting matte or high-gloss surface. The sides of the carton 11 have dust flaps 12, and the top of the carton 14 has a tuck flap 16 that tucks inside the front 18.

Figure 2:
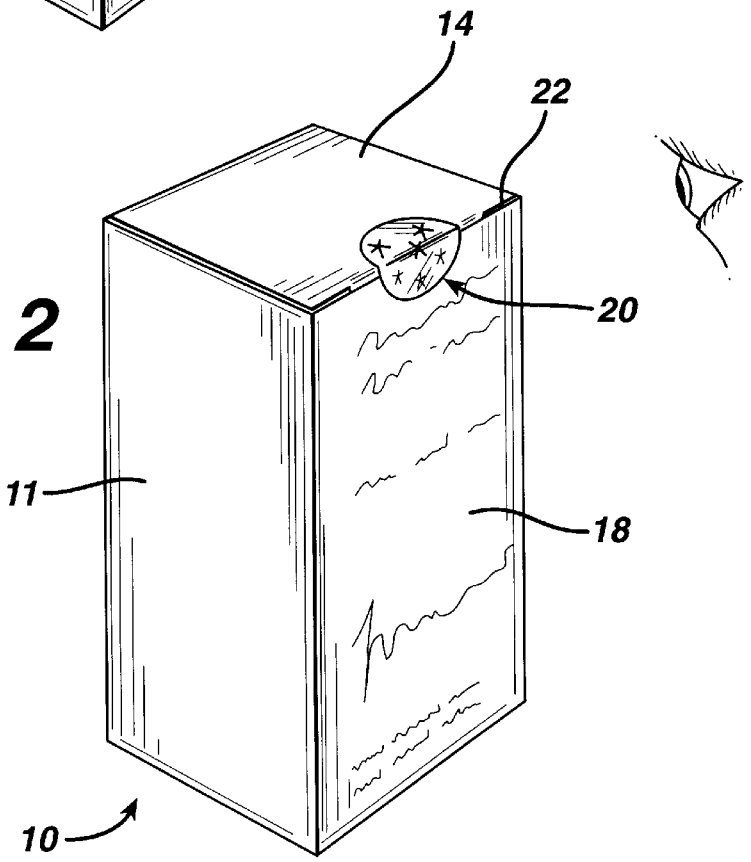
FIG. 2 depicts the carton of FIG. 1 sealed with a closure seal of the present invention.

Seal 20 may be applied to carton 10 either manually or by automated methods well known in the art. As shown in FIG. 2, when seal 20 is in place, it bridges a narrow gap 22 between top 14 and front 18. Alternatively it could bridge the gap between the top 14 and a side 11. However, if a sharp object is slid along the gap 22, closure seal 20 can be cleanly cut and carton 10 can be opened. If seal 20 had either no pattern at all or had a colored pattern, then carton 10 could be resealed with little or no indication that the carton had been opened, simply by overlaying a transparent seal of the same size in register. But that tampering technique is thwarted by seal 20. If seal 20 is tampered with and then later covered by a transparent seal, the tampering will be evident, as will be clear from FIGS. 3 and 4. The pattern on seal 20, as was stated above, is formed by adjoining high-gloss and matte areas. The pattern is, therefore, particularly apparent when viewed at an oblique angle. For example, as depicted in FIG. 2, an eye positioned as shown would see the pattern more clearly on the part of the seal that is on top of the carton.

Figure 3:
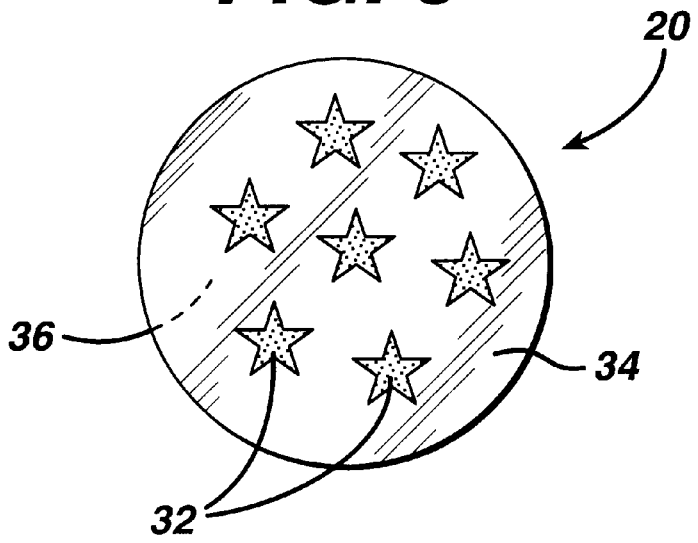
FIG. 3 is a top view of a closure seal of the present invention.

FIG. 3 depicts a top view of a closure seal 20 of the present invention. Pattern 32 is formed with a high-gloss or matte varnish coating on a contrasting matte or high-gloss top surface 34. Clearly, the pattern could have any form, but it would typically be distinctive, such as a company name or logo. Pattern 32 is preferably a repeating random pattern, to eliminate the need to orient the seal and to simplify placement of the closure seal on the carton. For the same reason, the seal is preferably a circle, although it may have any convenient shape, such as oval, rectangular, etc. An oval seal is preferred for use with a narrow elongated carton, the long dimension of the oval paralleling the long dimension of the carton. Bottom surface 36 has an adhesive coating.

The materials that comprise the seal—substrate, printing varnish on the top, and adhesive coating on the bottom—are preferably all transparent, so that any underlying graphics and/or copy on carton 10 remain visible when the seal is in place. The closure seal substrate may be of a clear thermoplastic film, such as acetate or polyester. For example, 7723 Scotchmark®, available from the 3M Corp., St. Paul, Minn., and Mylar®, a similar product available from DuPont, Wilmington, Del., are suitable. Preferably, the substrate surface is matte, in which case the pattern 32 may be formed by a glossy varnish. Solvent Safe®, available from Louis O. Werneke Co., Plymouth, Minn., is preferred. The adhesive coating 36 preferably has sufficient permanence so that the closure seal cannot be removed, after being pressed against the carton, without the removal being evident, even if the seal is subsequently reapplied. Evidence of removal may be carton fiber tears, ink removal, or destruction of the seal. Among various "permanent" adhesives that are suitable for use with paperboard cartons are UC-50 UltraClear Acrylic, available from the 3M Corp., St. Paul, Minn.

Figure 4:
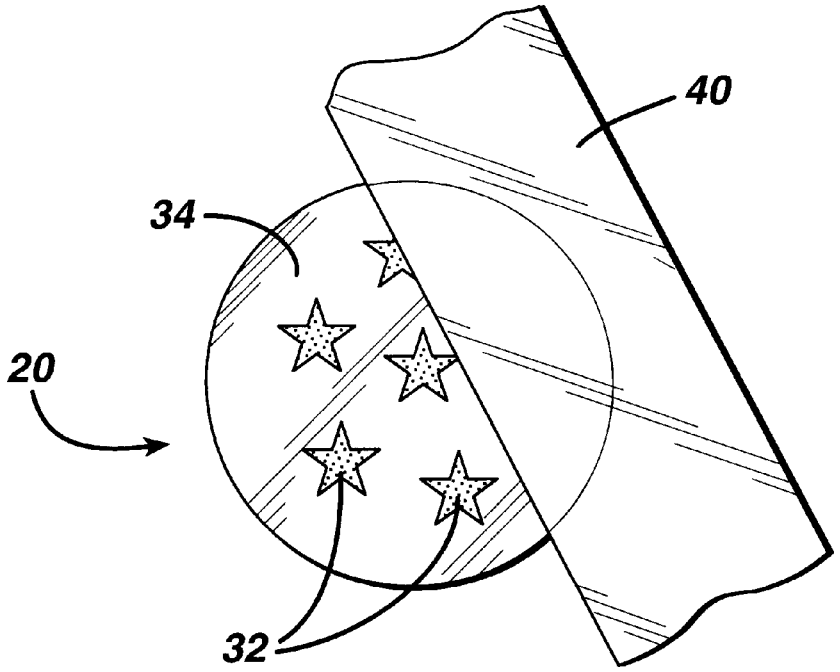
FIG. 4 is a top view of the seal of FIG. 3, partially overlaid with transparent tape.

FIG. 4 is a top view of the seal 20 of FIG. 3, partially covered by transparent tape 40. Even though tape 40 is transparent, those parts of pattern 32 that are covered by tape 40 are not visible. Tape 40 has substantially uniform reflectance, and its reflectance masks the contrasting reflectance pattern 32 on the surface of seal 20. Thus, even if transparent tape 40 is the same size and shape as seal 20 and is placed over it in register, its presence will be apparent to the distributor and, if a message on the carton calls attention to the pattern on the closure seal, to the consumer as well.

I claim:

1. A visual tamper-evident closure seal having a top surface and a bottom surface, the bottom surface having an adhesive coating and the top surface having on it a pattern formed by adjoining high-gloss and matte areas, whereby the pattern is rendered invisible when covered with a clear transparent adhesive tape.

2. The seal of claim 1 in which the top surface is a matte surface on which a high-gloss image has been imprinted to form the pattern.

3. The seal of claim 1 in which the pattern is a repeating pattern.

4. The seal of claim 1 in which the seal is substantially transparent.

5. A visual tamper-evident carton having an edge seam that constitutes a gap between two carton surfaces at right angles to each other, the gap being bridged by a closure seal having a top surface and a bottom surface, the bottom surface having an adhesive coating and the top surface having on it a pattern formed by adjoining high-gloss and matte areas, whereby the pattern is rendered invisible when covered with a clear transparent adhesive tape.

6. The carton of claim 5 in which the top surface of the seal is a matte surface on which a high-gloss image has been imprinted to form the pattern.

7. The carton of claim 5 in which the pattern on the seal is a repeating pattern.

8. The carton of claim 5 in which the seal is a substantially circular disk that is generally bisected by the seam.

9. The carton of claim 5 in which the seal is a substantially oval disk that is generally bisected by the seam.

10. The carton of claim 5 in which the adhesive on the seal and the carton material to which it is adhered are selected so that it is readily apparent if the seal is removed from the carton and then reapplied.

* * * * *